United States Patent [19]

Loh

[11] Patent Number: 4,796,886

[45] Date of Patent: Jan. 10, 1989

[54] HOME TENNIS PRACTICE APPARATUS

[76] Inventor: George A. Loh, 1344 Tarpon St., Foster City, Calif. 94404

[21] Appl. No.: 882,952

[22] Filed: Jul. 7, 1986

[51] Int. Cl.[4] ..... A63B 69/38

[52] U.S. Cl. ..... 273/29 A; 273/401

[58] Field of Search ..... 273/29 A, 402, 182 R, 273/181 A, 181 F, 127 B, 127 R, 407, 410, 181 R, 185 R, 323, 324, 184 R, 348, 378, 396, 397, 398, 399, 400, 401, 402

[56] References Cited

U.S. PATENT DOCUMENTS

| | | | |
|---|---|---|---|
| 1,923,152 | 8/1933 | Hohn | 273/181 A |
| 2,043,273 | 6/1936 | Watson | 273/181 A |
| 3,215,432 | 11/1965 | Lee et al. | 273/29 A |
| 3,873,969 | 3/1975 | Ziel | 273/181 A |
| 4,492,380 | 1/1985 | Sayfar | 273/181 F |

FOREIGN PATENT DOCUMENTS

| | | | |
|---|---|---|---|
| 662904 | 3/1963 | Canada | 273/181 F |
| 21909 | of 1906 | United Kingdom | 273/181 F |
| 384786 | 12/1951 | United Kingdom | 273/29 A |
| 197804 | 5/1978 | United Kingdom | 273/181 F |

*Primary Examiner*—Richard C. Pinkham
*Assistant Examiner*—T. Brown

[57] ABSTRACT

A tennis practice apparatus (10) has a supporting surface net (12). The net (12) is divided into a lower portion (18) corresponding in height to a regulation tennis net and two court portions (20, 22) above the tennis net portion (18). Elastics (14) position the net (12) in a substantially vertical position. Target pockets (26, 28, 30, 34, 36, 38) are positioned in the court portions (20, 22) of the net (12). The target pockets (26, 28, 30, 34, 36, 38) each have an opening at the net (12). The target pockets (26, 28, 30, 34, 36, 38) are dimensioned and configured to receive a tennis ball directed at one of the openings.

4 Claims, 1 Drawing Sheet

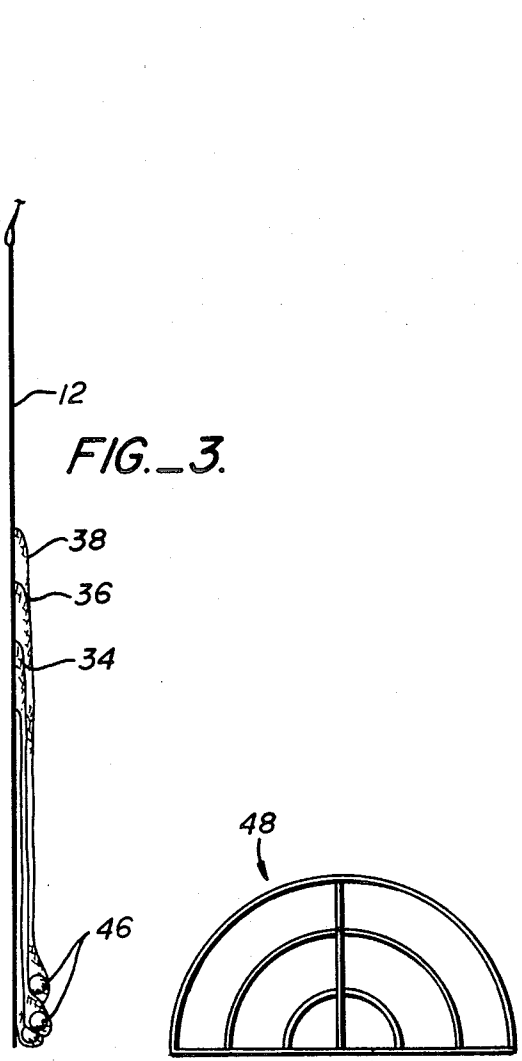
FIG._3.
FIG._4.
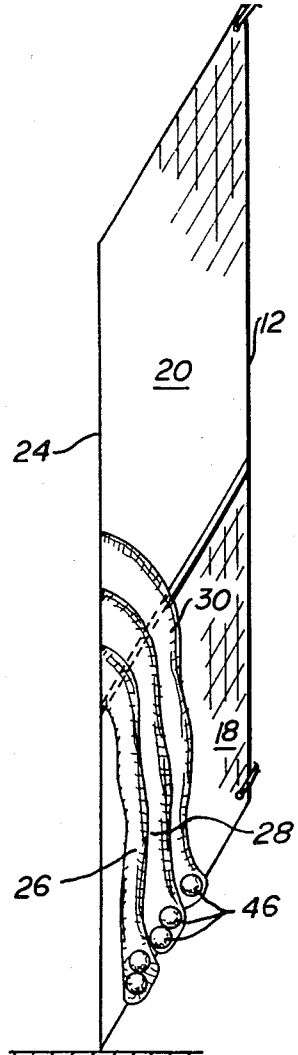
FIG._2.
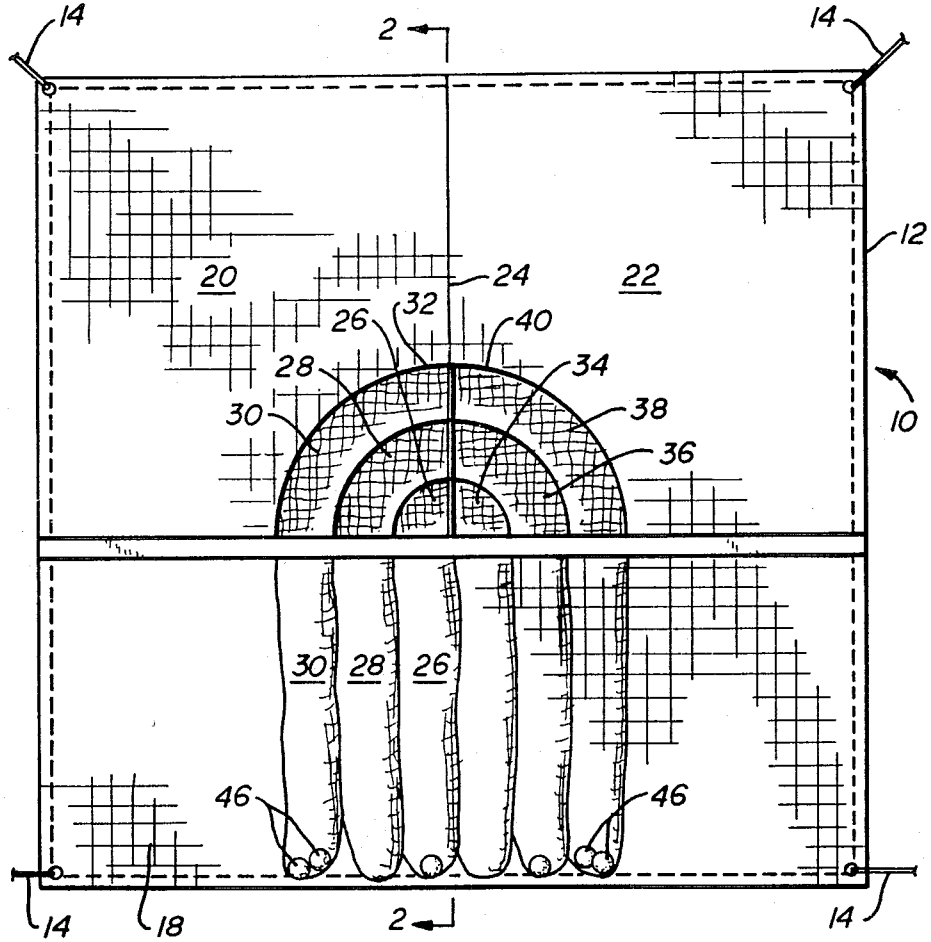
FIG._1.

HOME TENNIS PRACTICE APPARATUS

BACKGROUND OF THE INVENTION

1. Field of the Invention

This invention relates to a novel form of a tennis practice apparatus that can be used in a limited space. More particularly, it relates to such a practice apparatus that allows the user to duplicate tennis court conditions for practicing tennis serves in a limited space, such as a backyard. Most especially, the invention relates to such an apparatus that will allow two players to practice tennis serves in a competitive game using the apparatus.

2. Description of the Prior Art

It has long been recognized that tennis is a game requiring a great deal of practice to play well. For most people, a court is not always conveniently available for such practice. If a court is available, an opponent may not be available. For these and similar reasons, a variety of tennis practice devices are known in the art. For example, such devices are shown in the following issued U.S. patents: U.S. Pat. Nos.: 2,280,376, issued Apr. 21, 1942 to Clark; 3,180,643, issued Apr. 27, 1965 to Kallai; 3,563,544, issued Febr. 16, 1971 to Hedrick; 4,082,271, issued Apr. 4, 1978 to Martin; 4,160,549, issued July 10, 1979 to Simpson; 4,204,679, issued May 27, 1980 to Kreuzman and 4,231,572, issued Nov. 4, 1980 to Thornton. A variety of practice devices for other sports are also known in the art, for example, as disclosed in the following issued U.S. patents: U.S. Pat. Nos. 3,583,703, issued June 8, 1971 to Brown et al.; 3,856,298, issued Dec. 24, 1974 to Frantii and 4,295,648, issued Oct. 20, 1981 to Stromback. The prior art tennis practice devices are complex in construction and/or they are designed for use on a conventional tennis court. As a result, such devices have achieved only limited acceptance in the marketplace. While the art pertaining to such devices is a reasonably well developed one, as shown by the above issued patents, a need still remains for further development of such apparatus to meet the needs of the average tennis player.

SUMMARY OF THE INVENTION

Accordingly, it is an object of this invention to provide a tennis practice apparatus that is low in cost and will duplicate conditions on a tennis court for serving a tennis ball in a user's backyard or other limited space.

It is another object of the invention to provide such a tennis practice apparatus that will allow the user to determine easily the quality of practice serves made while using the apparatus.

It is a further object of the invention to provide such a tennis practice apparatus which may be used by more than one user in a competitive practice game to sharpen their serving skills.

It is still another object of the invention to provide such a tennis practice apparatus which is quiet in use.

The attainment of these and related objects may be achieved through use of the novel tennis practice apparatus herein disclosed. A tennis practice apparatus in accordance with this invention has a supporting surface. The supporting surface is divided into a lower portion corresponding in height to a regulation tennis net and at least one court portion above the tennis net portion. A means positions the supporting surface in a substantially vertical position. A first plurality of target pockets are positioned in the at least one court portion of the supporting surface. The target pockets each have an opening at the supporting surface. The target pockets are dimensioned and configured to receive a tennis ball directed at one of the openings. The supporting surface and the target pockets are preferably formed from net material.

In use, a user serves tennis balls at the target pockets. A tennis ball successfully hit at one o the openings enters one of the target pockets. The user can measure his success by counting the number of balls in each target pocket.

The attainment of the foregoing and related objects, advantages and features of the invention should be more readily apparent to those skilled in the art, after review of the following more detailed description of the invention, taken together with the drawings, in which:

BRIEF DESCRIPTION OF THE DRAWINGS

FIG. 1 is a front view of a tennis practice apparatus in accordance with the invention.

FIG. 2 is a perspective and cross section view of the tennis practice apparatus of FIG. 1, taken along the line 2—2 in FIG. 1.

FIG. 3 is a side view of the tennis practice apparatus of FIGS. 1 and 2.

FIG. 4 is a plan view of a portion of the tennis practice apparatus of FIGS. 1–3.

DETAILED DESCRIPTION OF THE INVENTION

Turning now to the drawings, more particularly to FIGS. 1–3, there is shown a tennis practice apparatus 10 in accordance with the invention. The apparatus 10 has a vertically extending net 12, with elastic supports 14 for hanging the net 12 from suitable supports (not shown), which may be trees or posts, for example. The net 12 has a bottom portion 18 corresponding in height to the height of a regulation tennis net, i.e., 36 inches. Above the bottom portion 18, the net 12 is divided into a deuce court portion 20 and an add court portion 22 by vertically extending line 24. A plurality of pockets 26, 28 and 30 extend concentrically above portion 18 of the net 12 and to the left of line 24. The pockets 26, 28 and 30 are formed from netting, hang down behind the net 12 as is best shown in FIG. 2, and are open at the net 12 to form an overall quarter circle shaped target 32 in the deuce court portion 20 of the net 12. A similar set of pockets 34, 36 and 38 to the right of line 24 forms a target 40 in the add court portion 22 of the net 12. The net 12 desirably has overall dimensions of 7 feet by 7 feet. As is best shown in FIG. 4, a wire frame 48 corresponding in shape to the targets 32 and 40 and the openings of the pockets 26–30 and 34–38 is sewn into the net 12 to provide structural support for the openings.

In use, the user stands a serving distance in front of the apparatus 10 and serves tennis balls 46 toward the target areas 32 or 40. Because the tennis balls hit within the target areas 32 or 40 will enter one of the pockets 26–30 or 34–38, the user does not need to judge whether the balls were within a target area 32 or 40. For scoring purposes, point values are assigned to the pockets, based on the difficulty of serving the tennis balls to the particular pockets, for example, 4 points for the pockets 26 and 34, 2 points for the pockets 28 and 36 and 1 point for the pockets 30 and 38. Contrasting color or different design balls are preferably used for each of the target areas 32 or 40, to make it clear which was the intended target.

For a competitive game with more than one player, each player uses 8 balls, 4 of one color or design and 4 of another color or design. Using the basic rules of tennis, one of the players starts by serving two of the balls to the left or deuce court area 20, aiming for the pocket 26, which is called an ACE (4 points) for each ball entering that pocket. After serving both balls, the player serves two of the contrasting color or design balls and serves to the add court area 22, aiming for the pocket 34. The player repeats the above sequence with the remaining four balls. The next player repeats the same process until his 8 balls are served out. The points are totaled, and the player with the highest points wins this particular game. The players repeat the whole process until one player reaches 6 games with the other player winning 4 games or less as in regular tennis rules to complete a set. There will be a tie breaker if the score reaches 6-6 and the tie breaker rules apply as in regular tennis, i.e., the player who reaches 7 points with a margin of at least 2 points wins. The first point of the tie breaker is played from the right court serving to the left court area 20, with the service then alternating as in the normal tennis scoring system. The same rules can apply to doubles play or even 3 triples play. There is no limit to the number of players.

The apparatus 10 can be used in any space that measures at least about 7 feet wide, 10 feet high and 30 feet long, such as in a small back yard or garage. While larger areas are obviously more desirable, considerably less space is required than for a regular tennis court. While the above description explains use of the apparatus 10 for practicing serves, it can also be used for practicing other tennis strokes, such as forehand and backhand strokes, using both the target areas 32 and 40 and the remainder of the net 22 to judge whether the ball when hit toward the apparatus would be in or out of bounds or below the net in a regular tennis game.

It should now be readily apparent to those skilled in the art that a novel tennis practice and game apparatus capable of achieving the stated objects of the invention has been provided. The apparatus of this invention can be used in a small space, without access to a regulation tennis court. The apparatus duplicates closely the conditions of an actual tennis serve, and the user is easily able to judge the quality of the practice serves. The apparatus is simple in construction and quiet in use. More than one user can use the apparatus in a competitive mode.

It should further be apparent to those skilled in the art that various changes in form and detail of the invention as shown and describe may be made. It is intended that such changes be included within the spirit and scope of the claims appended hereto.

What is claimed is:

1. A tennis practice apparatus, which comprises a supporting surface, said supporting surface being divided into a lower portion corresponding in height to a regulation tennis net and at least one court portion above said tennis net portion, means for positioning said supporting surface in a substantially vertical position, at least first and second target pockets positioned in said at least one count portion of said supporting surface, said at least first and second target pockets each having an opening at said supporting surface, said at least first and second target pockets being dimensioned and configured to receive a tennis ball directed at one of the openings, said first target pocket having its opening of a first area and being positioned immediately above said tennis net portion, said second target pocket having its opening of a second area greater than the first area, at least part of the second area being spaced from said tennis net portion by the first area, said supporting surface including at least a second court portion above said tennis net portion and beside said at least one court portion, and at least third and fourth target pockets in said second court portion corresponding to said first and second target pockets.

2. The tennis practice apparatus of claim 1 in which said at least first and second and at least third and fourth target pockets are concentrically arranged at an intersection between said first and second court portions to form substantially quarter circle target areas.

3. The tennis practice apparatus of claim 2 additionally comprising fifth and sixth target pockets, said fifth and sixth target pockets each having an opening at said supporting surface respectively having a fifth and a sixth area in the form of substantially quarter circle target areas each being respectively greater than either the first and second areas or the third and fourth areas and respectively being positioned so that the fifth and sixth areas of said fifth and sixth target pockets are partially separated form said tennis net portion by the first and second areas and third and fourth areas.

4. A tennis practice apparatus, which comprises a supporting surface, said supporting surface being divided into a lower portion corresponding in height to a regulation tennis net and at least one court portion above said tennis net portion, means for positioning said supporting surface in a substantially vertical position, at least first and second target pockets positioned in said at least one court portion of said supporting surface, said at least first and second target pockets each having an opening at said supporting surface, said at least first and second target pockets being dimensioned and configured to receive a tennis ball directed at one of the openings, said first target pocket having its opening of a first area and being positioned immediately above said tennis net portion, said second target pocket having its opening of a second area greater than the first area, at least part of the second area being spaced from said tennis net portion by the first area, a third target pocket having an opening at said supporting surface having a third area greater than either the first and second areas and being positioned so that the third area is at least partially separated from said tennis net portion by the first and second areas, said supporting surface including at least a second court portion above said tennis net portion and beside said at least one court portion, and fourth, fifth and sixth target pockets in said second court portion corresponding to said first, second and third target pockets.

* * * * *